US007954862B2

(12) United States Patent
Defert

(10) Patent No.: US 7,954,862 B2
(45) Date of Patent: Jun. 7, 2011

(54) ELECTROMAGNETIC LOCK PROVIDED WITH A SLIDING BOLT FOR A SWINGING-TYPE DOOR

(75) Inventor: Jean-Michel Defert, Sannois (FR)

(73) Assignee: Digit, Pantin (FR)

( * ) Notice: Subject to any disclaimer, the term of this patent is extended or adjusted under 35 U.S.C. 154(b) by 935 days.

(21) Appl. No.: 10/597,508

(22) PCT Filed: Jan. 18, 2005

(86) PCT No.: PCT/FR2005/000054

§ 371 (c)(1),
(2), (4) Date: Nov. 3, 2006

(87) PCT Pub. No.: WO2005/083211

PCT Pub. Date: Sep. 9, 2005

(65) Prior Publication Data

US 2008/0223092 A1 Sep. 18, 2008

(30) Foreign Application Priority Data

Jan. 28, 2004 (FR) ..... 04 00773

(51) Int. Cl.
*E05C 19/16* (2006.01)
*E05C 1/06* (2006.01)

(52) U.S. Cl. ..... 292/251.5; 292/144

(58) Field of Classification Search ..... 292/251.5, 292/137, 146, 150, 163, 341.16, 340; 70/144, 70/278.1–278.7

See application file for complete search history.

(56) References Cited

U.S. PATENT DOCUMENTS

| | | | | | |
|---|---|---|---|---|---|
| 178,382 | A * | 6/1876 | Roosevelt | 292/164 |
| 473,061 | A * | 4/1892 | Crockett et al. | 70/279.1 |
| 608,321 | A * | 8/1898 | Carleton | 292/144 |
| 1,238,345 | A * | 8/1917 | Schoenle | 292/201 |
| 1,558,705 | A * | 10/1925 | Milligan | 70/280 |
| 1,635,028 | A * | 7/1927 | Burr et al. | 70/280 |
| 2,081,055 | A * | 5/1937 | Kiracofe | 292/201 |
| 2,153,088 | A * | 4/1939 | Knell | 292/150 |
| 2,586,900 | A * | 2/1952 | Alderman | 292/74 |
| 4,519,640 | A * | 5/1985 | Mombelli | 292/33 |
| 4,620,735 | A * | 11/1986 | Heydner | 292/144 |
| 6,053,546 | A * | 4/2000 | Frolov | 292/251.5 |
| 6,630,877 | B2 * | 10/2003 | Manthey | 335/205 |

FOREIGN PATENT DOCUMENTS

| | | |
|---|---|---|
| FR | 2720779 | 12/1995 |
| GB | 177176 | 3/1922 |
| GB | 225254 | 12/1924 |

* cited by examiner

*Primary Examiner* — Carlos Lugo
*Assistant Examiner* — Alyson M Merlino
(74) *Attorney, Agent, or Firm* — Greenblum & Bernstein, P.L.C.

(57) ABSTRACT

Electromagnetic lock includes a body, a retractable sliding bolt, and a movable plate structured and arranged to move the retractable sliding bolt and functioning as an armature of an electromagnet housed in the body. The movable plate is movable via two forces acting in the same direction and is structured and arranged to move the retractable sliding bolt to a protruding position. This Abstract is not intended to define the invention disclosed in the specification, nor intended to limit the scope of the invention in any way.

28 Claims, 1 Drawing Sheet

ELECTROMAGNETIC LOCK PROVIDED WITH A SLIDING BOLT FOR A SWINGING-TYPE DOOR

CROSS-REFERENCE TO RELATED APPLICATIONS

The present application is a National Stage Application of International Application No. PCT/FR2005/000054, filed Jan. 18, 2005, which published as WO 2005/083211 on Sep. 9, 2005. Further, the present application claims priority under 35 U.S.C. §119 of French Patent Application No. 04/00773 filed on Jan. 28, 2004.

BACKGROUND OF THE INVENTION

1. Field of the invention

The instant invention relates to an electromagnetic lock provided with a retractable sliding bolt for a swinging-type door, that is, a lock comprising a doubly-tapered bolt. The door is openable by pulling or pushing.

2. Discussion of Background Information

In known locks, the bolt slides in the opening plane by compressing a return spring when an action is exerted against the door.

To oppose the opening of the door, these locks are provided with a locking device preventing the bolt from sliding backward. The device is made of a movable mechanical member that prevents the bolt from sliding back in the locking position.

In general, the movable mechanical locking member is controlled by an electromagnet which, when energized, maintains the aforementioned member in the locking position. If the electromagnet is no longer energized, the aforementioned member retracts by means of a return spring.

Such a lock cannot be used in the case of a door which, while being maintained closed, must be openable, should fortuitous event, such as a fire alarm, occur.

The occurrence of such an event triggers the opening of the electrical circuits, either automatically, or by the security staff.

In general, the alarm trigger causes a panic situation, whereby a large number of people exert an action on the door (an emergency exit, for example), which results in each door being suddenly subjected to a substantial force, and the moving parts (bolt and movable locking member) being blocked one against the other. Experience has shown that a power shut-off has no effect because the force of the return spring is much too insufficient to overcome the force pressing the movable members against one another.

The solution would be to interrupt the power supply as soon as an ill-timed event occurs; but here again, experience has shown that this synchronization is very difficult to achieve.

SUMMARY OF THE INVENTION

The lock according to the invention, which overcomes these drawbacks, is characterized in that the conventional bolt is supported by the movable armature of an electromagnet. The armature keeps the bolt in the locking position by the action of two forces acting in the same direction. One of the forces results from the spring action, and the other from the action of the electromagnet core when it is energized.

When the electromagnet is energized, the locking is efficient and the bolt is not displaceable.

When the electromagnet is not energized, the bolt is in the exit position, in engagement with the catch, by the action of the springs, and the door is therefore maintained closed in the opening plane. However, pressure on the door makes it possible to slide the bolt backward.

The invention also provides for an electromagnetic lock comprising a body, a retractable sliding bolt, and a movable plate structured and arranged in the body to support the retractable sliding bolt and to function as an armature of an electromagnet. The movable plate is movable via two forces acting in the same direction and is structured and arranged to move the retractable sliding bolt to a protruding position.

At least one of the retractable sliding bolt is configured for a swinging-type door, the retractable sliding bolt comprises a projecting portion having oppositely arranged tapered surfaces, and the retractable sliding bolt comprises a pointed projecting portion.

The movable plate and the retractable sliding bolt are movable in the same direction. The movable plate and the retractable sliding bolt are movable along a bolt displacement direction. The two forces acting in the same direction are generated by springs and the electromagnet. The springs bias the movable plate and the retractable sliding bolt towards the protruding position. The movable plate is guided on columns and the columns comprise axes which are arranged parallel to a bolt displacement direction.

The invention also provides for an electromagnetic lock comprising an electromagnetic core, a retractable sliding bolt, an armature plate supporting the retractable sliding bolt, and springs biasing the armature plate towards the electromagnetic core. When the electromagnetic core is energized, the armature plate positions the retractable sliding bolt in a protruding position and maintains the electromagnetic lock in a locked position. When the electromagnetic core is not energized, forces generated by the springs maintain the protruding position of the retractable sliding bolt.

The retractable sliding bolt is configured for a swinging-type door, and wherein, when the electromagnetic core is not energized, only forces generated by the springs maintain the protruding position of the retractable sliding bolt. The springs are mounted to members passing through the armature plate. The armature plate is guided on columns with axes which are arranged parallel to a bolt displacement direction. At least one of the retractable sliding bolt comprises a projecting portion having oppositely arranged tapered surfaces and the retractable sliding bolt comprises a pointed projecting portion.

The invention also provides for an electromagnetic lock comprising a body, an electromagnetic core arranged in the body, a bolt member comprising a protruding portion and being movable to a protruding position, an armature plate arranged in the body, and springs arranged in the body and biasing the armature plate towards the electromagnetic core. When the electromagnetic core is energized, the electromagnetic lock is maintained in a locked position. When the electromagnetic core is not energized, forces generated by the springs maintain the protruding position until the bolt member experiences a force tending to move the bolt member into the body.

When the electromagnetic core is not energized, only forces generated by the springs maintain the protruding position of the bolt member. The retractable sliding bolt is configured for a swinging-type door and the projecting portion includes oppositely arranged tapered surfaces. The springs are mounted to members passing through the armature plate.

The invention also provides for a method of locking a door, wherein the method comprises arranging the electromagnetic lock described above on an edge of the door, arranging a catch plate on a fixed member, the plate comprising an opening receiving therein the protruding portion of the bolt member, and energizing the electromagnetic core in order maintained the locked position, wherein, when the electromagnetic core is de-energized, biasing forces generated by the springs maintain engagement between the opening and the protruding portion of the retractable sliding bolt.

When the electromagnetic core is de-energized, biasing forces generated only by the springs maintain engagement between the opening and the protruding portion of the retractable sliding bolt, and the springs oppose and allow movement of the bolt member into the body.

The invention also provides for a method of locking a door, wherein the method comprises arranging the electromagnetic lock of described above on an edge of the door, arranging a catch plate on a fixed member, the plate comprising an opening receiving therein a protruding portion of the retractable sliding bolt, and energizing an electromagnetic core in order maintained a locked position, wherein, when the electromagnetic core is de-energized, biasing forces generated only by springs maintain engagement between the opening and the protruding portion of the retractable sliding bolt.

The invention also provides for a method of locking a door, wherein the method comprises arranging the electromagnetic lock of described above on an edge of the door, arranging a catch plate on a fixed member, the plate comprising an opening receiving therein a protruding portion of the retractable sliding bolt, and energizing the electromagnetic core in order maintained the locked position, wherein, when the electromagnetic core is de-energized, biasing forces generated only by the springs maintain engagement between the opening and the protruding portion of the retractable sliding bolt.

BRIEF DESCRIPTION OF THE DRAWINGS

The invention will be better understood from the description that follows, with reference to the annexed drawings and by way of non-limiting examples, in which.

DETAILED DESCRIPTION OF THE INVENTION

Figure 1:
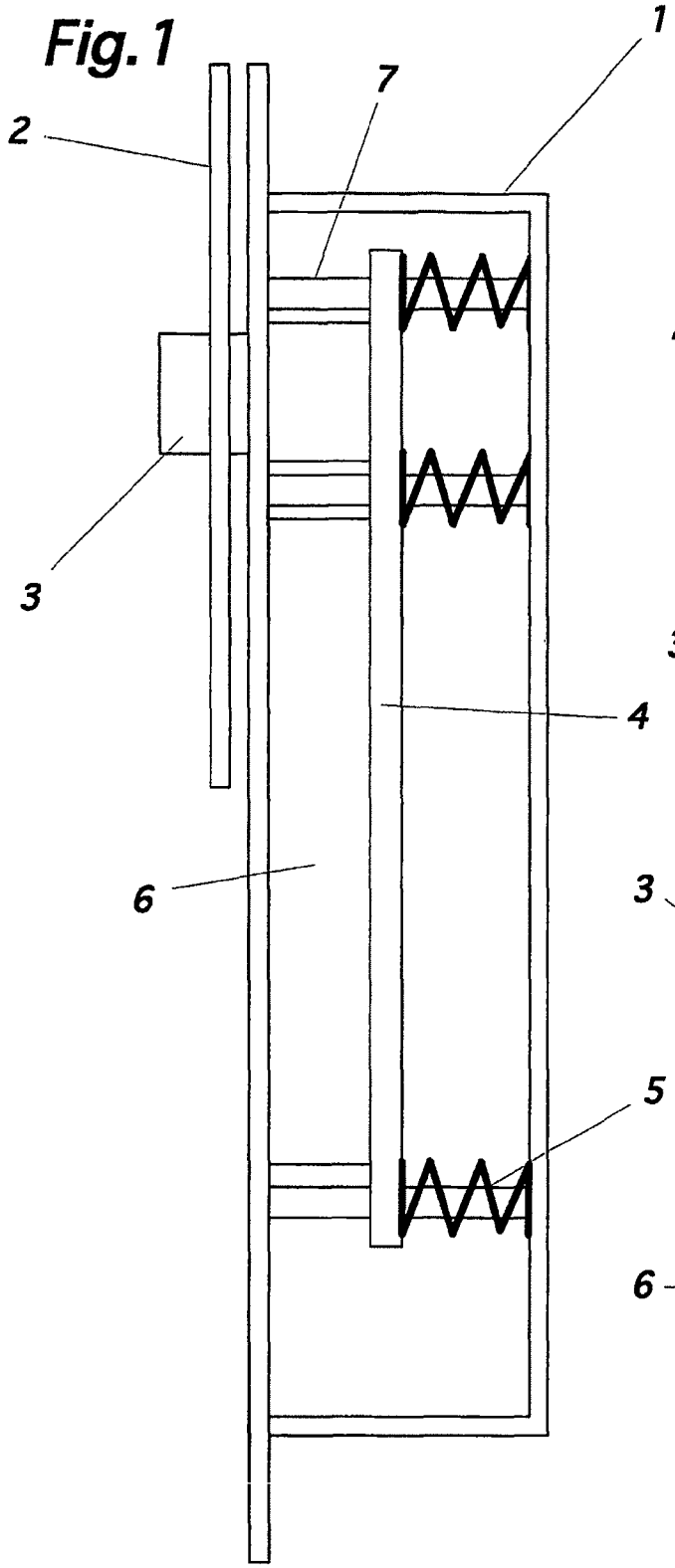
FIG. 1 is a top view of a lock according to the invention.

Referring to the drawings, the lock includes, as known, a body 1 fixed, for example, to the edge of the door. A plate 2 is fastened on the fixed portion and forms the catch for retaining the bolt 3.

According to the invention, the bolt 3 is supported by another plate 4, which is displaceable parallel to the edge comprising the plate 2.

The plate 4 is subjected to the action of springs 5 that tend to displace the plate 4 in order to make the bolt 3 protrude.

Figure 2:
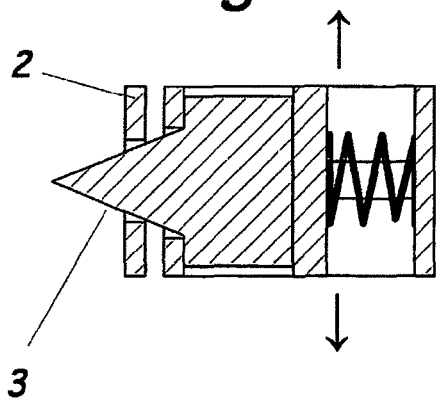
FIG. 2 is a cross-sectional view along the line II-II of FIG. 1.
Figure 3:
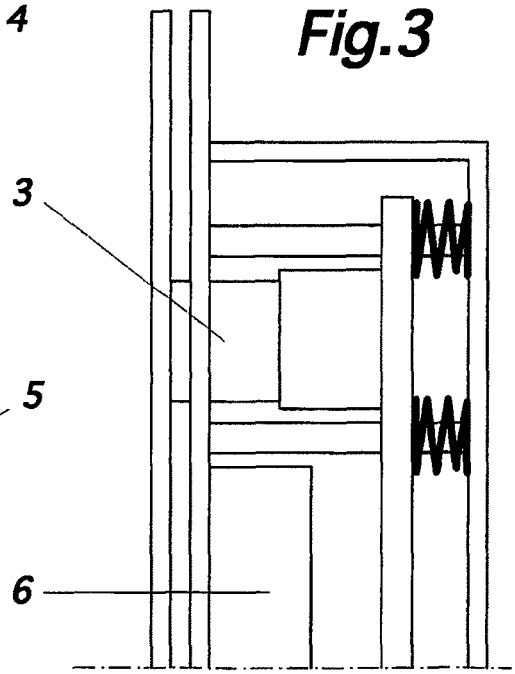
FIG. 3 is a view, similar to that of 1, showing the position of the movable members during the door opening.

The plate 4 forms the movable armature of an electromagnet. The core 6 of the electromagnet, when energized, displaces the plate 4 in view of making the bolt 3 protrude and then opposes its sliding backward. This is the position shown in FIGS. 1 and 2, which show that the springs 5 press the plate 4 against the core 6.

As seen from the figures, the plate 4 is guided on columns 7. The .axes of these columns 7 are parallel to the bolt 3 displacement direction. The springs 5 are advantageously guided on columns 7.

In its normal operation, the electromagnet is energized and the bolt 3 therefore cannot slide backward: in this state, the lock is locked.

If the power supply to the electromagnet is interrupted, the bolt 3 stays engaged with the catch by action of the springs 5, the door remains closed but not locked, and a mere push on the latter will make it possible to open it.

If a fortuitous event causes a panic situation, people will rush to the doors, exerting a substantial amount of pressure thereon; but this pressure will help with the door opening while the installation's electric power supply is disconnected.

From the above explanations, one can see that the lock according to the invention, contrary to known locks, ensures great safety during a panic reaction.

The invention claimed is:

1. An electromagnetic lock comprising:

a body;

a linearly movable retractable sliding bolt;

an electromagnet core arranged in the body; and a movable plate arranged in the body and being structured and arranged to contact and support the retractable sliding bolt and to function as an armature of an electromagnet, wherein the movable plate is movable via two forces acting in the same direction and is structured and arranged to move the retractable sliding bolt linearly to a protruding position, and wherein one of:

the movable plate moves the retractable sliding bolt to the protruding position; and the electromagnet core is arranged between a front side of the movable plate and a free end of the retractable sliding bolt.

2. The lock of claim 1, wherein at least one of:

the retractable sliding bolt is configured for a swinging-type door;

the retractable sliding bolt comprises a projecting portion having oppositely arranged tapered surfaces; and the retractable sliding bolt comprises a pointed projecting portion.

3. The lock of claim 1, wherein the movable plate and the retractable sliding bolt are movable in the same direction.

4. The lock of claim 1, wherein the movable plate and the retractable sliding bolt are movable along a bolt displacement direction.

5. The lock of claim 1, wherein the two forces acting in the same direction are generated by springs and the electromagnet.

6. The lock of claim 5, wherein the springs bias the movable plate and the retractable sliding bolt towards the protruding position.

7. The lock of claim 1, wherein the movable plate is guided on columns and the columns comprise axes which are arranged parallel to a bolt displacement direction.

8. The lock of claim 1, wherein the electromagnet core is arranged between the movable plate and a protruding portion of the retractable sliding bolt when the retractable sliding bolt is positioned in the protruding position.

9. The lock of claim 8, further comprising springs arranged on a side of the movable plate opposite the retractable sliding bolt, wherein, when the electromagnet core is energized, the retractable sliding bolt is prevented from moving back away from the protruding position and wherein, when the electromagnet core is not energized, only the springs act to prevent the retractable sliding bolt from moving back away from the protruding position.

10. The lock of claim 1 wherein the movable plate is guided linearly in the body when the retractable sliding bolt moves to the protruding position and is guided linearly when the retractable sliding bolt moves away from the protruding position and wherein the electromagnetic lock is arranged on a swinging-type door.

11. The lock of claim 1, wherein the movable plate moves the retractable sliding bolt to the protruding position and the electromagnet core is arranged between the front side of the movable plate and the free end of the retractable sliding bolt.

12. The lock of claim 11, wherein the electromagnet core is arranged between the movable plate and a plate having an opening through which a protruding portion of the retractable sliding bolt projects.

13. An electromagnetic lock comprising:

an electromagnetic core;

a linearly movable retractable sliding bolt;

an armature plate supporting the retractable sliding bolt; and springs biasing the armature plate towards the electromagnetic core, wherein, when the electromagnetic core is energized, the armature plate linearly moves and positions the retractable sliding bolt in a protruding position and maintains the electromagnetic lock in a locked position, and wherein, when the electromagnetic core is not energized, forces generated by the springs maintain the protruding position of the retractable sliding bolt.

14. The lock of claim 13, wherein the retractable sliding bolt is configured for a swinging-type door, and wherein, when the electromagnetic core is not energized, only forces generated by the springs maintain the protruding position of the retractable sliding bolt.

15. The lock of claim 13, wherein the springs are mounted to members passing through the armature plate.

16. The lock of claim 13, wherein the armature plate is guided on columns with axes which are arranged parallel to a bolt displacement direction.

17. The lock of claim 13, wherein at least one of the retractable sliding bolt comprises a projecting portion having oppositely arranged tapered surfaces; and the retractable sliding bolt comprises a pointed projecting portion.

18. The lock of claim 13, wherein the electromagnetic core is arranged between the armature plate and a protruding end of the retractable sliding bolt when the retractable sliding bolt is positioned in the protruding position.

19. The lock of claim 13, wherein the armature plate is guided linearly when the retractable sliding bolt moves to the protruding position and is guided linearly when the retractable sliding bolt moves away from the protruding position and wherein the electromagnetic lock is arranged on a swinging-type door.

20. An electromagnetic lock comprising:

a body;

an electromagnetic core arranged in the body;

a bolt member comprising a protruding portion and being movable linearly to a protruding position;

an armature plate arranged in the body; and springs arranged in the body and biasing the armature plate towards the electromagnetic core, wherein, when the electromagnetic core is energized, the electromagnetic lock is maintained in a locked position, and wherein, when the electromagnetic core is not energized, forces generated by the springs maintain the protruding position until the bolt member experiences a force tending to move the bolt member linearly into the body.

21. The lock of claim 20, wherein, when the electromagnetic core is not energized, only forces generated by the springs maintain the protruding position of the bolt member.

22. The lock of claim 20, wherein the bolt member is configured for a swinging-type door and the projecting portion includes oppositely arranged tapered surfaces.

23. The lock of claim 20, wherein the springs are mounted to members passing through the armature plate.

24. The lock of claim 20, wherein the electromagnetic core is arranged between the armature plate and the protruding portion of the bolt member when the bolt member is positioned in the protruding position, wherein the armature plate is guided linearly when the bolt member moves to the protruding position and is guided linearly when the bolt member moves away from the protruding position, and wherein the electromagnetic lock is arranged on a swinging-type door.

25. A method of locking a door, the method comprising:

arranging the electromagnetic lock of claim 20 on an edge of the door;

arranging a catch plate on a fixed member, the catch plate comprising an opening receiving therein the protruding portion of the bolt member; and energizing the electromagnetic core in order to maintain the locked position.

26. The method of claim 25, wherein, when the electromagnetic core is de-energized, biasing forces generated only by the springs maintain engagement between the opening and the protruding portion of the bolt member, and the springs oppose and allow movement of the bolt member into the body.

27. A method of locking a door, the method comprising:

arranging the electromagnetic lock of claim 1 on an edge of the door;

arranging a catch plate on a fixed member, the catch plate comprising an opening receiving therein a protruding portion of the retractable sliding bolt; and energizing the electromagnet core in order to maintain a locked position, wherein, when the electromagnet core is de-energized, biasing forces generated only by springs maintain engagement between the opening and the protruding portion of the retractable sliding bolt.

28. A method of locking a door, the method comprising:

arranging the electromagnetic lock of claim 13 on an edge of the door;

arranging a catch plate on a fixed member, the catch plate comprising an opening receiving therein a protruding portion of the retractable sliding bolt; and energizing the electromagnetic core in order to maintain the locked position.

* * * * *